US008706481B2

(12) United States Patent
Lee et al.

(10) Patent No.: US 8,706,481 B2
(45) Date of Patent: Apr. 22, 2014

(54) MULTI-PATH TRELLIS CODED QUANTIZATION METHOD AND MULTI-PATH CODED QUANTIZER USING THE SAME

(75) Inventors: Kang Eun Lee, Gangneung-si (KR); Eun Mi Oh, Seongnam-si (KR); Ho Sang Sung, Yongin-si (KR); Chang Yong Son, Gunpo-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 716 days.

(21) Appl. No.: 11/608,956

(22) Filed: Dec. 11, 2006

(65) Prior Publication Data

US 2007/0233473 A1 Oct. 4, 2007

(30) Foreign Application Priority Data

Apr. 4, 2006 (KR) ..... 10-2006-0030576

(51) Int. Cl.
*G10L 19/12* (2013.01)

(52) U.S. Cl.
USPC ..... 704/222; 704/219; 704/230

(58) Field of Classification Search
USPC ..... 704/230, 222, 219, 221, 207
See application file for complete search history.

(56) References Cited

U.S. PATENT DOCUMENTS

| | | | | |
|---|---|---|---|---|
| 5,271,089 | A * | 12/1993 | Ozawa | 704/222 |
| 6,148,283 | A * | 11/2000 | Das | 704/222 |
| 7,003,171 | B1 | 2/2006 | Takeo | |
| 2004/0002856 | A1* | 1/2004 | Bhaskar et al. | 704/219 |
| 2004/0230429 | A1* | 11/2004 | Son et al. | 704/230 |

FOREIGN PATENT DOCUMENTS

| | | |
|---|---|---|
| KR | 10-0486732 | 4/2005 |
| WO | WO 03/052943 | 6/2003 |

OTHER PUBLICATIONS

Ji, Tingfang et. al., "Modified Viterbi Algorithm for Predictive TCQ", Mar. 31, 1999, IEEE.*
Korean International Search Report dated Mar. 14, 2006 issued in PCT/KR2006/005422.
Forney, G.D. Jr., The Viterbi Algorithm, Proceedings of the IEEE, Mar. 1973, vol. 61, No. 3, p. 272.
Supplementary European Search Report dated Dec. 20, 2011 issued in EP Application No. 06824126.4.
Extended European Search Report dated Jan. 12, 2012 issued in EP Application No. 06824126.4.
T. Ji et al: "Modified Viterbi algorithm for predictive TCQ", Proceedings DCC'99 Data Compression Conference (CAT. No. PR00096), Jan. 1, 1999, p. 532, XP55012489, DOI: 10.1109/DCC.1999.785689 ISBN: 978-0-76-950096-6 *title* *lines 5-17, 32-24*.

* cited by examiner

*Primary Examiner* — Richemond Dorvil
*Assistant Examiner* — Mark Villena
(74) *Attorney, Agent, or Firm* — Stanzione & Kim, LLP

(57) ABSTRACT

A method of multi-path trellis coded quantization (TCQ) usable in a speech coding system, and a quantizer using the method. Specifically the method includes calculating accumulated distortions corresponding to 2N survivor paths, wherein N indicates an integer greater than two, each of the 2N survivor paths is going towards one of nodes at an i th stage of a trellis, and i indicates an integer greater than zero, comparing the accumulated distortions respectively corresponding to the 2N survivor paths to select N paths among the 2N survivor paths, wherein the accumulated distortions corresponding to selected N paths are smaller than the accumulated distortions corresponding to unselected N paths establishing the selected N paths as survivor paths going toward an i+1 th stage, and selecting an optimal path among the 2N survivor paths corresponding to each node of a last stage.

18 Claims, 9 Drawing Sheets

CONVENTIONAL TCQ ENCODING

MULTI-PATH TCQ ENCODING

MULTI-PATH TRELLIS CODED QUANTIZATION METHOD AND MULTI-PATH CODED QUANTIZER USING THE SAME

CROSS-REFERENCE TO RELATED APPLICATIONS

This application claims priority under 35 U.S.C §119(a) from Korean Patent Application No. 10-2006-0030576, filed on Apr. 4, 2006, in the Korean Intellectual Property Office, the disclosure of which is incorporated herein in its entirety by reference.

BACKGROUND OF THE INVENTION

1. Field of the Invention

The present general inventive concept relates to a method of multi-path trellis coded quantization, and more particularly, to a method of multi-path trellis coded quantization which can be used in a speech coding system, and a quantizer using the method.

2. Description of the Related Art

For high quality speech coding in a speech coding system, it is very important to efficiently quantize linear predictive coding (LPC) coefficients indicating a short interval correlation of a speech signal. In an LPC filter, an optimal LPC coefficient value is obtained so that after an input voice signal is divided into frame units, energy of a prediction error for each frame is minimized. An LPC filter of an adaptive multi-rate wideband (AMR-WB) speech codec, which is standardized as a wideband speech codec for an International Mobile Telecommunications-2000 (IMT-2000) system in a 3rd Generation Partnership Project (3GPP), is a 16th all-poll filter, and in this case many bits must be allocated for quantization of 16 LPC coefficients.

Even for quantization of 10 LPC coefficients, many bits must be allocated. For example, IS-96A Qualcomm code excited linear prediction (QCELP), which is a speech coding method used in a code division multiple access (CDMA) mobile communications system, uses 25% of a total number of bits for LPC quantization, and more specifically, the AMR-WB speech codec uses from a maximum 27.3% to a minimum 9.6% of a total number of bits for LPC quantization. So far, many methods for efficient quantization of LPC coefficients have been developed and are actually being used in voice compression apparatuses. One of these methods, direct quantization of LPC filter coefficients, has problems in that an LPC filter is too sensitive to quantization errors of LPC coefficients, and stability of the LPC filter after quantization is not guaranteed. Accordingly, LPC coefficients should be converted into other parameters having a good quantization characteristic and then quantized, i.e., reflection coefficients, and line spectrum frequency (LSF) coefficients. Moreover, most standard speech coders utilize an LSF quantization speech coding method since the LSF coefficients are closely associated with speech signal frequency properties.

Also, more effective quantization may be accomplished when correlations among frames of the LSF coefficients are utilized, i.e., an LSF of a current frame is predicted from LSF information of a past frame, and a predicted error between the current and past frames is quantized, instead of an LSF of a current frame being directly quantized. Because LSF coefficient values are closely associated with speech signal frequency properties which are predictable over time, a comparatively larger prediction gain may be obtained.

As for a method of filtering the LSF coefficient values, there are methods using an auto-regressive (AR) filter and a moving average (MA) filter. The AR filter has a good prediction performance, however, the AR filter suffers from a transmission error effect resulting from a receiving station continuously propagating a transmission error throughout a frame progression. The MA filter also has a comparatively inferior prediction performance, however the transmission error effect is limited. Subsequently, a prediction method of the LSF coefficient values using the MA filter is utilized in wireless mobile communication circumstances, where transmission errors frequently occur, as a speech coder, e.g. adaptive multi-rate (AMR), AMR-WB, and selectable mode vocoder (SMV). Also, besides the LSF coefficient value prediction among frames, a prediction method using correlation among adjacent LSF constituent values within a single frame has been developed where the LSF coefficient values always repeat an ordering property, so that performance of quantization may be maximized when the above described method is utilized.

Methods of quantization of prediction error of LSF coefficients can be divided into two types, scalar quantization methods and vector quantization methods. At present, the vector quantization method is more widely used than the scalar quantization method. Although the vector quantization method uses more bits, it provides better performance as compared to the scalar quantization method.

In the vector quantization method, quantization of entire vectors at one time is impossible because a size of a vector table grows too big and searching takes too much time. To solve these problems, a method by which vectors are divided into a plurality of sub-vectors and each sub-vector is independently vector quantized has been developed, and is referred to as a split vector quantization (SVQ) method. As an example, when quantization of a $10^{th}$ vector using 20 bits is performed at one time, the size of the vector table grows to be approximately $10\times2^{20}$, however, when a lattice vector method is used, in which the $10^{th}$ vector using 20 bits is divided into two $5^{th}$ sub-vectors to be quantized, a size of a vector table grows to be only approximately $5\times2^{10}\times2$.

A method and a quantizer of quantization of a line spectrum frequency coefficient using block constrained trellis coded quantization (BC-TCQ) and a speech coding system is disclosed in Korean Patent No. 10-486732. In the Korean Patent No. 10-486732, bits allocated to an initial state may be reduced by providing a constraint at both an initial and a final stage in trellis coded quantization (TCQ), in order to provide a method of coded quantization having a good signal to noise ratio (SNR) and to reduce the number and complexity of codebook searching calculations. This also results in a memory size required for quantization of an input signal and coefficient to be minimized.

In spite of the above mentioned merits, conventional TCQ techniques still have a problem that a path having a minimum accumulated distortion is disregarded because only one survivor path is stored at each stage.

Accordingly, a new method of trellis coded quantization capable of effectively searching a path on a trellis having a smaller accumulated distortion, and a quantizer using the method is needed.

SUMMARY OF THE INVENTION

The present general inventive concept provides a method of multi-path trellis coded quantization which improves performance of quantization at a lower transmission rate, and a quantizer using the method.

The present general inventive concept also provides a method of multi-path trellis coded quantization which solves a problem occurring when only one survivor path is stored in a trellis coded quantization using an input signal correlation, and a quantizer using the method.

The present general inventive concept also provides a method of multi-path trellis coded quantization which improves performance of quantization by effectively performing quantization of an input signal and a coefficient in a speech coding system using a block constrained-TCQ (BC-TCQ), and a quantizer using the method.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a method of multi-path trellis coded quantization, the method including calculating accumulated distortions corresponding to 2N survivor paths, wherein N indicates an integer greater than two, each of the 2N survivor paths going towards one of nodes at an $i^{th}$ stage of a trellis, and i indicates an integer greater than zero, comparing the accumulated distortions respectively corresponding to the 2N survivor paths to select N paths among the 2N survivor paths, wherein the accumulated distortions corresponding to selected N paths are smaller than the accumulated distortions corresponding to unselected N paths, establishing the selected N paths as survivor paths going toward an $i+1^{th}$ stage, and selecting an optimal path among the 2N survivor paths corresponding to each node of a last stage.

The calculating of accumulated distortions may include generating a predicted value corresponding to the $i^{th}$ stage of the trellis by using a quantized value among the 2N survivor paths, calculating 2N prediction errors at the $i^{th}$ stage of the trellis by using the predicted value, calculating a distortion between representative values selected from a sub-codebook which is allocated to a branch corresponding to the $i^{th}$ stage of the trellis and the predicted errors, and calculating the accumulated distortion of the $i^{th}$ stage by using the distortion.

The foregoing and/or other aspects of the present general inventive concept may also be achieved by providing multi-path trellis coded quantizer including an accumulated distortion calculation unit to calculate accumulated distortion corresponding to 2N survivor paths, wherein N indicates an integer greater than two, each of the 2N survivor paths is going toward one of nodes at an $i^{th}$ stage of a trellis, and i indicates an integer greater than zero, a survivor path establishment unit to compare the accumulated distortions respectively corresponding to the 2N survivor paths to select N paths among the 2N survivor paths, wherein the accumulated distortions corresponding to selected N paths are smaller than the accumulated distortions corresponding to unselected N paths, and to establish the selected N paths as survivor paths going toward an $i+1^{th}$ stage, and an optimal path selection unit to select an optimal path among the 2N survivor paths corresponding to each node of a last stage.

The accumulated distortion calculation unit may include a prediction unit to generate a predicted value corresponding to the $i^{th}$ stage of the trellis by using a quantized value among the 2N survivor paths, a prediction error calculation unit to calculate 2N prediction errors at the $i^{th}$ stage of the trellis by using the predicted value, a distortion calculation unit to calculate a distortion between representative values selected from a sub-codebook which is allocated to a branch corresponding to the $i^{th}$ stage of the trellis and the predicted errors, and an accumulation calculation unit to calculate the accumulated distortion of the $i^{th}$ stage by using the distortion.

The method of multi-path trellis coded quantization and the quantizer using the method may quantize a prediction error performed among frames of an input signal.

The method of multi-path trellis coded quantization and the quantizer using the method may quantize a preprocessed input signal.

The foregoing and/or other aspects of the present general inventive concept may also be achieved by providing a computer-readable recording medium having embodied thereon a computer program to execute a method of multi-path trellis coded quantization, the method including calculating each of accumulated distortions corresponding to each of 2N survivor paths, wherein N indicates an integer not less than two, each of the 2N survivor paths going towards one of nodes at an $i^{th}$ stage of a trellis, and i indicates an integer not less than zero, comparing the accumulated distortions respectively corresponding to the 2N survivor paths to select N paths among the 2N survivor paths, wherein the accumulated distortions corresponding to selected N paths are smaller than the accumulated distortions corresponding to unselected N paths, establishing the selected N paths as survivor paths going toward an $i+1^{th}$ stage, and selecting an optimal path among the 2N survivor paths corresponding to each node of a last stage.

The foregoing and/or other aspects of the present general inventive concept may also be achieved by providing a method of trellis coded quantization, the method including determining a plurality of survivor paths from a node of a first stage to a node of a last stage of a trellis structure, calculating accumulated distortion values for each of the plurality of survival paths, and selecting an optimal path from the plurality of survivor paths as a survival path based on the accumulated predetermined variable value.

The foregoing and/or other aspects of the present general inventive concept may also be achieved by providing a method of coding a voice input signal, the method including calculating linear predictive coding (LPC) coefficients corresponding to the voice input signal, calculating line spectrum frequency (LSF) coefficients based on the LPC coefficients, trellis code quantizing the LSF coefficients, the trellis code quantizing including determining a plurality of survivor paths from a node of a first stage to a node of a last stage of a trellis structure, calculating distortion values for each of the plurality of survival paths, and selecting an optimal path from the plurality of survivor paths as a survival path based on the accumulated predetermined variable value, and generating a bitstream according to the quantized LSF coefficients.

The foregoing and/or other aspects of the present general inventive concept may also be achieved by providing a method of searching a trellis structure, the method including determining 2N survivor paths between a first node of an $i^{th}$ stage and a second node of an $i+1^{th}$ stage of a trellis structure, calculating a predetermined variable corresponding to each of the 2N survivor paths, selecting N survivor paths from among the 2N survivor paths based on the predetermined variable, wherein N is an integer not less than 2.

Additional and/or other aspects and advantages of the present general inventive concept will be set forth in part in the description which follows and, in part, will be obvious from the description, or may be learned by practice of the general inventive concept.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
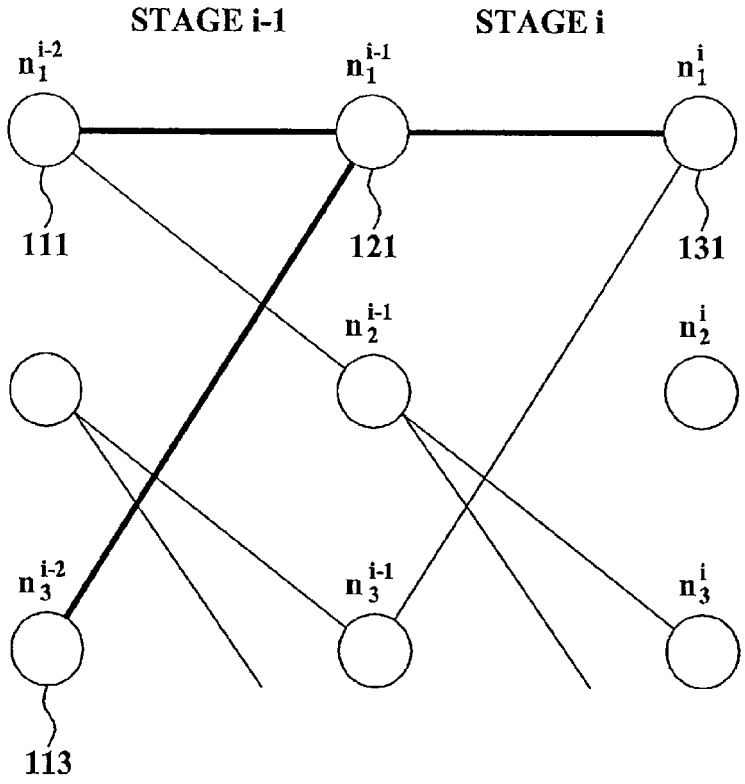
FIG. 1 is a diagram illustrating a trellis structure of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a diagram illustrating a trellis structure used in a method of multi-path coded quantization according to an exemplary embodiment of the present general inventive concept.

Referring to FIG. 1, in a method of trellis coded quantization (TCQ), an optimal path may be dismissed when only one survivor path is saved for one node at each stage. Specifically, when only one path among possible paths from a node 111 and a node 113 grows a survivor path for a node 121 at an $i^{th}$ stage to be transmitted to a next stage (stage i+1), a path passing the node 113 through the node 121 may be selected only for a node 131 of the $i^{th}$ stage, and a path passing the node 111 through the node 121 may not be selected. However, a survivor path may be calculated by performing a correlation of an input signal in the method of TCQ, such that the path passing the node 111 through the node 121 may have a smaller accumulated distortion than the path passing 113 through the node 121 for the node 131 of the $i^{th}$ stage.

Accordingly, two or more paths going toward each node at each stage are required to be stored to more effectively perform trellis coded quantization.

Figure 2A:
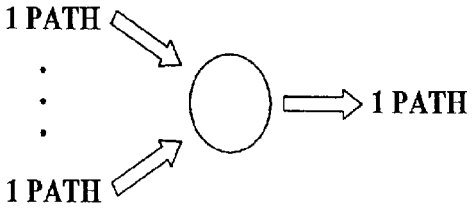
FIGS. 2A and 2B are conceptual diagrams illustrating a comparison between a conventional trellis coded quantization method (FIG. 2A) and a multi-path trellis coded quantization method of the present general inventive concept (FIG. 2B)
Figure 2B:
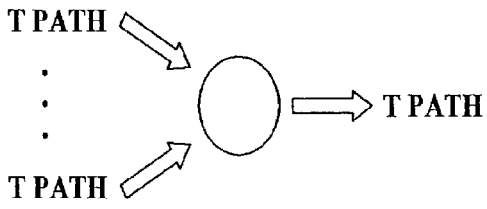

FIGS. 2A and 2B are conceptual diagrams illustrating a comparison between conventional trellis coded quantization method (FIG. 2A) and a multi-path trellis coded quantization method of the present general inventive concept (FIG. 2B).

Referring to FIGS. 2A and 2B, only one path of two paths going toward a specific node of a trellis is selected as a survivor path according to a conventional TCQ encoding method, and conversely according to a method of multi-path trellis coded quantization of the present general inventive concept, two or more paths of four or more paths going toward a specific node of a trellis are selected as survivor paths, i.e., the T in FIG. 2B indicates an integer greater than two.

As described above, a problem that a path having a smaller accumulated distortion is disregarded may be solved by storing two or more paths going toward one node at each stage, so that trellis coded quantization is more effectively performed.

Figure 3:
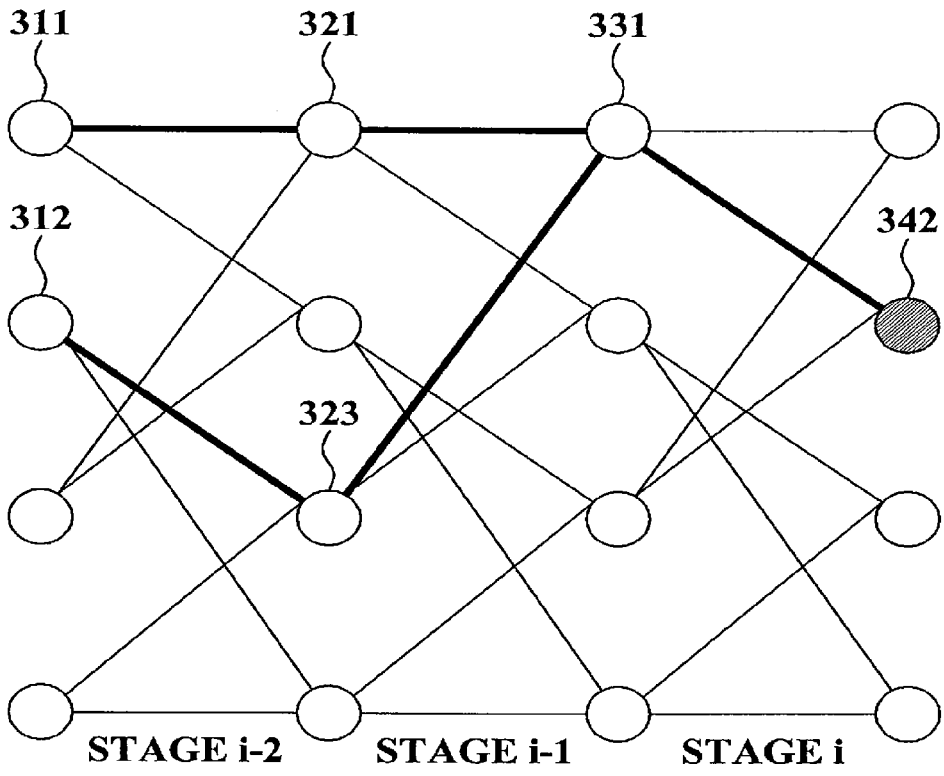
FIGS. 3, 4, and 5 are diagrams illustrating trellises usable in a method of multi-path trellis coded quantization according to an embodiment of the present general inventive concept.
Figure 4:
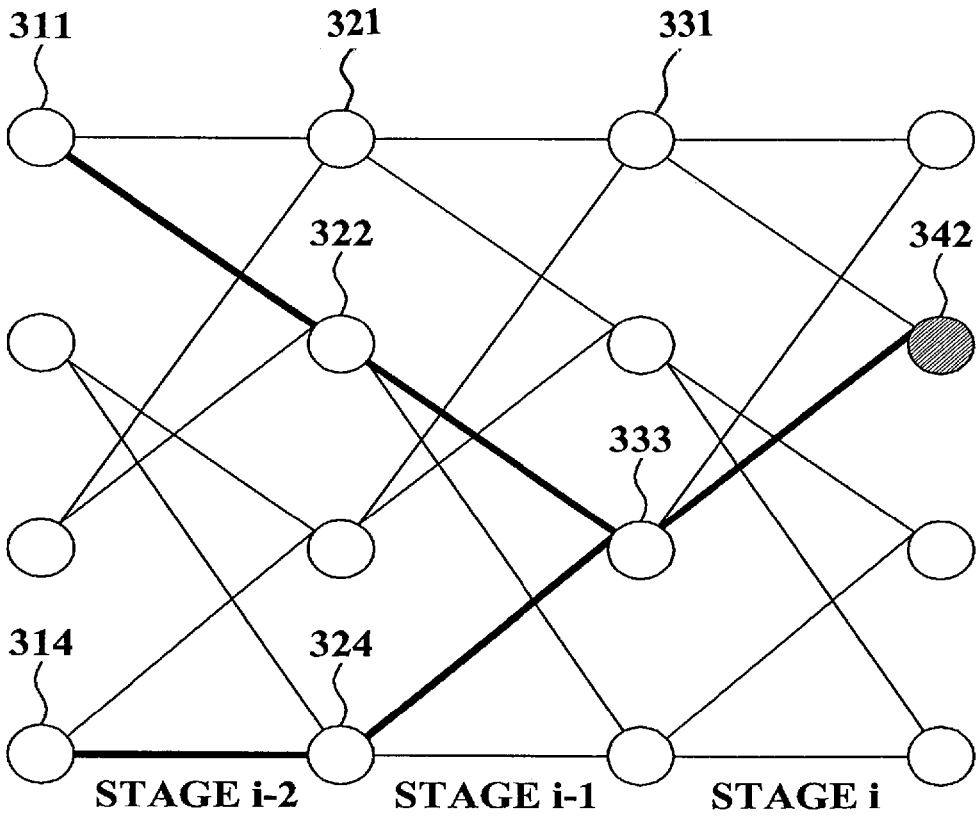
Figure 5:
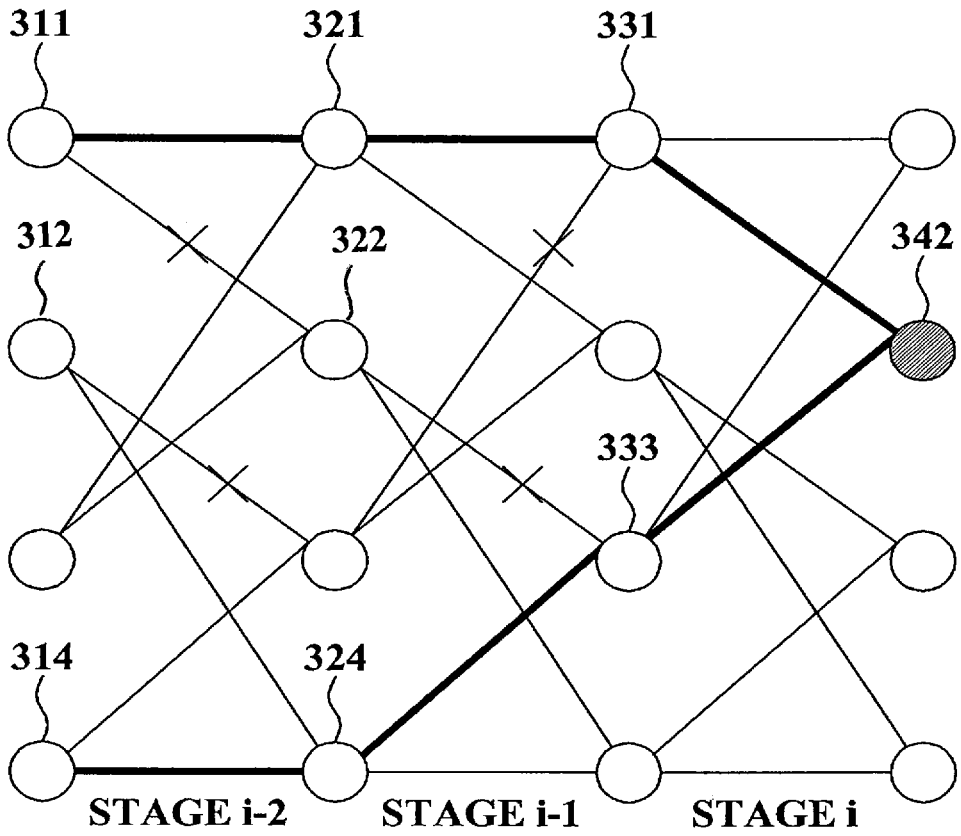

FIGS. 3, 4, and 5 are diagrams illustrating trellises and are useful to describe a method of multi-path trellis coded quantization according to an exemplary embodiment of the present general inventive concept.

Referring to FIG. 3, two survivor paths going toward a node 342, passing through a node 331, at an $i^{th}$ stage, are stored. Specifically, the two survivor paths going toward the node 342 through the node 331 are a first path passing through nodes 311, 321, and 331, and a second path passing through nodes 312, 323, and 331.

In this case, a distortion of a path connected to the nodes 311, 321, 331, and 342, and a distortion of a path connected to the nodes 312, 323, 331, and 342 is represented by equations 1 and 2 below, respectively:

$$d^i_{1,1,2} = \min(d(e_i^{1,1}, y^i_{1,2}) \mid y^i_{1,2} \in D^i_{1,2}) \qquad \text{Equation 1}$$

$$d^i_{3,1,2} = \min(d(e_i^{3,1}, y^i_{1,2}) \mid y^i_{1,2} \in D^i_{1,2}). \qquad \text{Equation 2}$$

In the present general inventive concept, $$\overline{e_k^{a,b}} = x_k - \hat{x}_k^{a,b}$$

indicates a prediction error. In this case, $x_k$ indicates an input at a $k^{th}$ stage, $$\hat{x}_k^{a,b} = \alpha \hat{x}_{k-1}^{a,b}.$$

Also, $\hat{x}_{k-1}^{a,b}$ indicates a value that an input $x_{k-1}$ at a $k-1^{th}$ stage is quantized by a node "b" at a $k-1^{th}$ stage and a node "a" at a $k-2^{th}$ stage. Also, d(a, b) (i.e., d(e,y)) indicates a distance between the "a" and the "b" nodes and may be either |a−b| or $(a-b)^2$. Also, $y^k_{a,b}$ indicates a sub-codebook entry allocated to a branch between a node "a" at a $k-1^{th}$ stage and a node "b" at a $k^{th}$ stage. Also, $D^k_{a,b}$ indicates the sub-codebook allocated to a branch between the node "a" at a $k-1^{th}$ stage and the node "b" at a $k^{th}$ stage. Detailed explanations regarding TCQ terminologies used in the present general inventive concept are disclosed in Korean Patent No. 486732, referred to herein in its entirety.

Referring to FIG. 4, it is illustrated that a number of survivor paths going toward a node 342 through a node 333 at an $i^{th}$ stage is two because two paths going toward one node at each stage are stored. Specifically, there are two survivor paths going toward the node 342 through the node 333, a first survivor path passing through nodes 311, 322, and 333, and a second survivor path passing through nodes 314, 324, and 333.

In this case, a distortion value of the first survivor path connected to the nodes 311, 322, 333, and 342, and the second survivor path connected to the nodes 314, 324, 333, and 342 is represented as equations 3 and 4 below, respectively:

$$d^i_{2,3,2} = \min(d(e_i^{2,3}, y^i_{3,2}) \mid y^i_{3,2} \in D^i_{3,2}) \quad \text{Equation 3}$$

$$d^i_{4,3,2} = \min(d(e_i^{4,3}, y^i_{3,2}) \mid y^i_{3,2} \in D^i_{3,2}). \quad \text{Equation 4}$$

As illustrated in FIGS. 3 and 4, four paths are going toward the node 342, i.e. two paths passing through the node 331, and another two paths passing through the node 333.

The method of multi-path trellis coded quantization according to an exemplary embodiment of the present general inventive concept may select two paths having a smaller accumulation of distortion, from among four paths going toward one node, as survivor paths.

Referring to FIG. 5, two paths, one passing through nodes 311, 321, and 331, and another passing through nodes 314, 324 and 333, from among four paths going toward a node 342, are selected as survivor paths. In this case, the method of multi-path trellis coded quantization according to an exemplary embodiment of the present general inventive concept may select two paths having a smaller accumulation of distortion, from among four paths going toward one node (e.g., node 342), as survivor paths. In this case, two paths which are not selected as survivor paths due to a large accumulation of distortion are the path passing through nodes 311, 322, and 333, and the path passing through nodes 312, 323, and 331. The two unselected paths are marked as "X" in FIG. 5.

Figure 6:
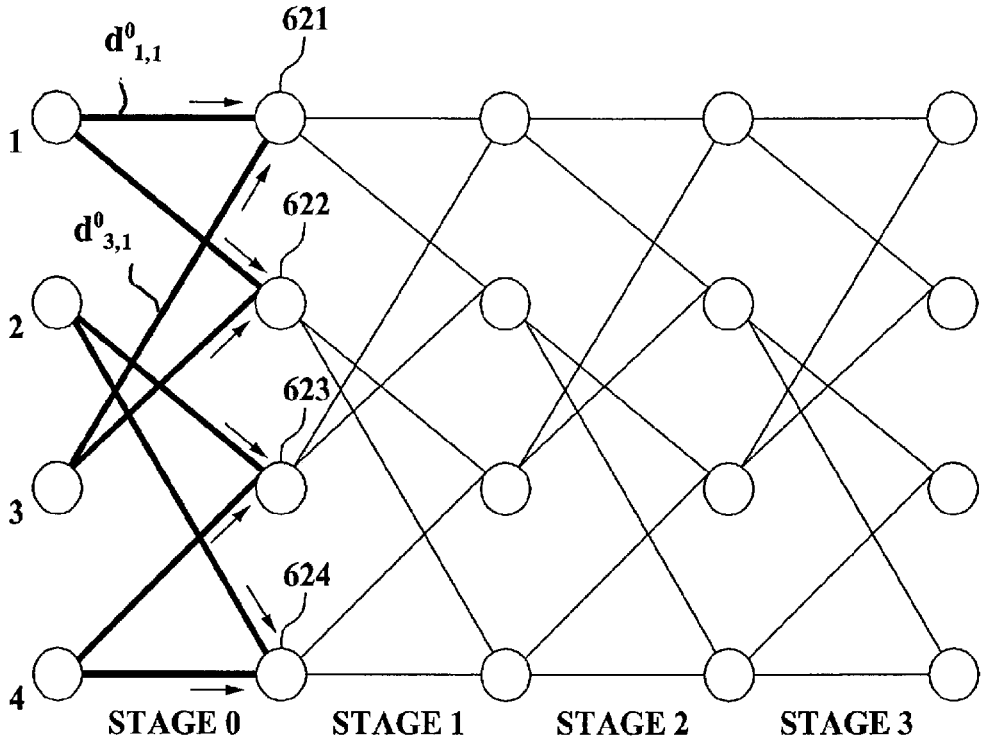
FIGS. 6, 7, and 8 are diagrams illustrating trellises usable in operations of multi-path trellis coded quantization according to an embodiment of the present general inventive concept.
Figure 7:
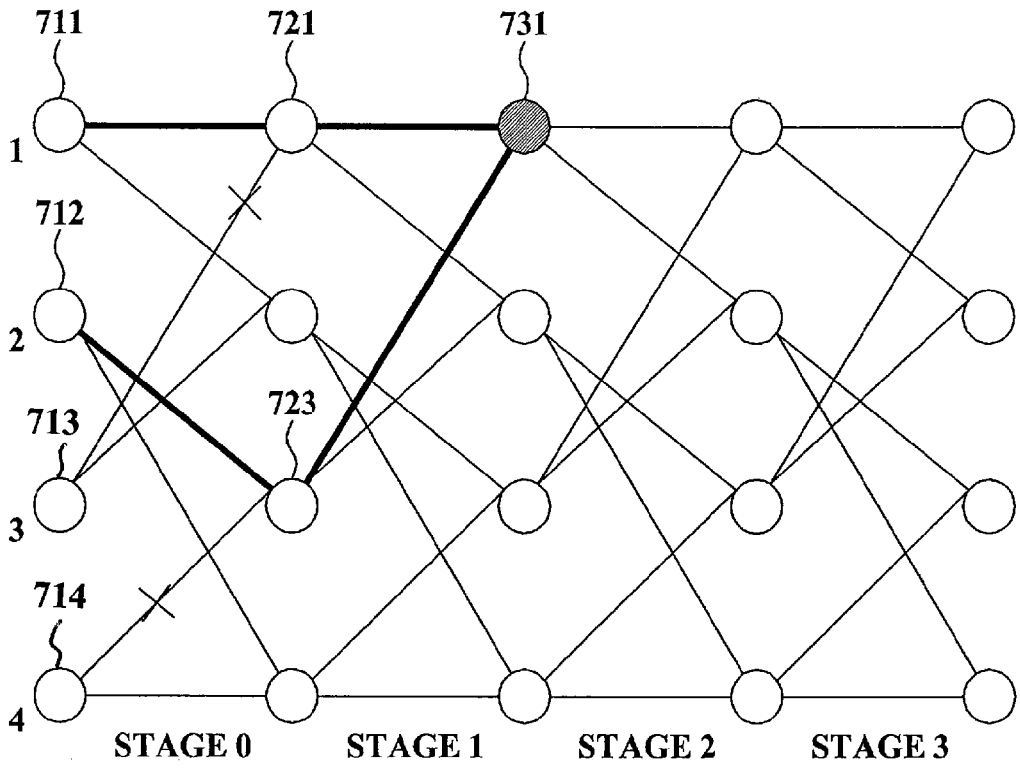
Figure 8:
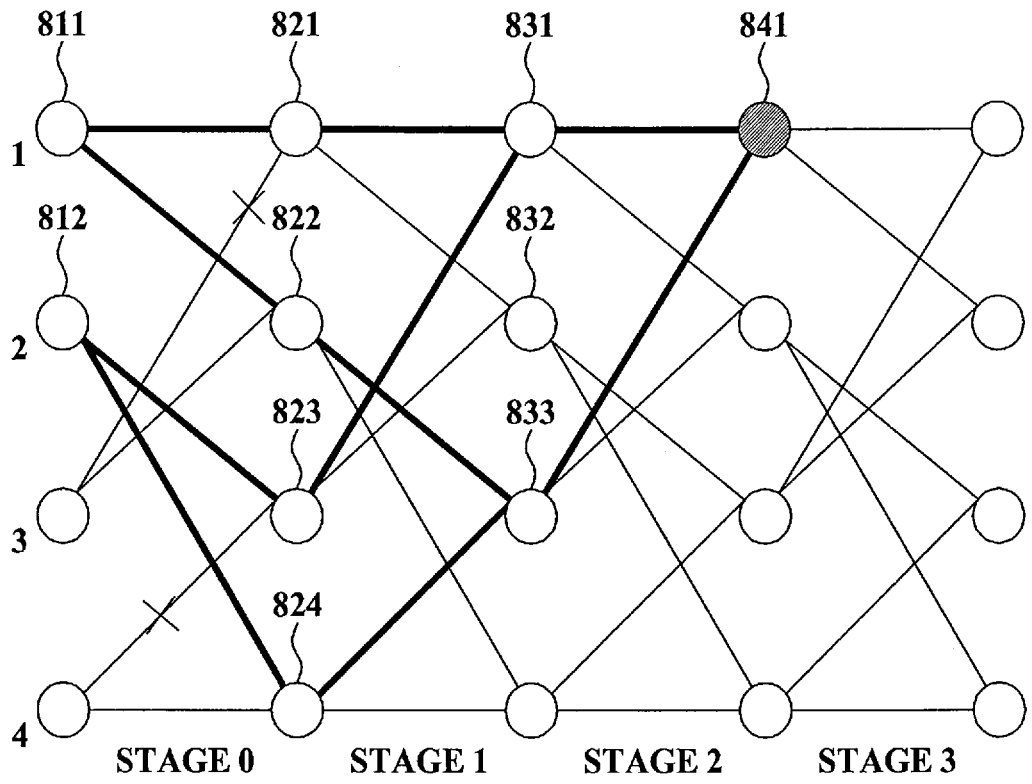

FIGS. 6, 7, and 8 are diagrams illustrating trellises useful to describe operations of multi-path trellis coded quantization according to an exemplary embodiment of the present general inventive concept. Referring to FIGS. 6, 7, and 8, the following operations of the embodiment are described with respect to each stage i of a trellis structure having i=4 stages, where i=0 is a first stage of a trellis and i=3 is a last stage of the trellis. The trellis of this embodiment of the present general inventive concept may represent prediction values between input signal frames or within a single input signal frame. The prediction values may be line spectrum frequency coefficient values, and the input signal may be a voice or speech signal and the line spectrum frequency coefficient values may be closely associated with a frequency property of the voice or speech signal.

Referring to FIG. 6, after searching input values $x^{1,1}_0$ and $x^{3,1}_0$ for a first node 621 at stage zero (i.e., i=0), distortion values $d^0_{1,1}$ and $d^0_{3,1}$ are calculated. Also, after searching input values $x^{1,2}_0$ and $x^{3,2}_0$ for a second node 622 at stage zero, distortion values $d^0_{1,2}$ and $d^0_{3,2}$ are calculated. Also, after searching input values $x^{2,3}_0$ and $x^{4,3}_0$ for a third node 623 at stage zero, distortion values $d^0_{2,3}$ and $d^0_{4,3}$ are calculated. Also, after searching input values $x^{2,4}_0$ and $x^{4,4}_0$ for a fourth node 624 at stage zero, distortion values $d^0_{2,4}$ and $d^0_{4,4}$ are calculated.

By way of example, $d^k_{a,b}$ indicates a distortion value of a sub-codebook, allocated to a branch between a node "a" at a $k-1^{th}$ stage and a node "b" at a $k^{th}$ stage of a trellis structure.

In this case, distortion value $d^i_{1,1}$ may be $\min(d(x_i, y^i_{1,1}) \mid y^i_{1,1} \in D^i_{1,1})$, and distortion value $d^i_{3,1}$ may be $\min(d(x_i, y^i_{3,1}) \mid y^i_{3,1} \in D^i_{3,1})$, where D represents sub-codebook entries of trellis paths between nodes of an $i^{th}$ stage.

Referring to FIG. 7, a method of multi-path trellis coded quantization of the present general inventive concept calculates prediction error values $e^{1,1}_1$, $e^{3,1}_1$, $e^{2,3}_1$, and $e^{4,3}_1$ for a node 731 at stage 1 (i.e., i=1) by using the distortion values calculated during the operation illustrated in FIG. 6. Also, the method of multi-path trellis coded quantization respectively compares entries of a sub-codebook $D^1_{1,1}$ with the prediction error values $e^{1,1}_1$ and $e^{3,1}_1$. Also, the method of multi-path trellis coded quantization respectively compares entries of a sub-codebook $D^1_{3,1}$ with the prediction error values $e^{2,3}_1$ and $e^{4,3}_1$.

Next, the method of multi-path trellis coded quantization calculates the distortion values $d^1_{1,1,1}$, $d^1_{3,1,1}$, $d^1_{2,3,1}$ and $d^1_{4,3,1}$ by using values found in the sub-codebook.

Also, the method of multi-path trellis coded quantization selects two paths having a smaller accumulated distortion after respectively calculating an accumulated distortion of distortion values $d^1_{1,1,1}+d^0_{1,1}$, $d^1_{3,1,1}+d^0_{3,1}$, $d^1_{2,3,1}+d^0_{2,3}$, and $d^1_{4,3,1}+d^0_{4,3}$. In an exemplary embodiment illustrated in FIG. 7, a path connecting nodes 711, 721, and 731, and a path connecting nodes 712, 723, and 731 are selected as survivor paths because the two paths have a smaller accumulated distortion than the other two paths. In this case, two paths which are not selected as survivor paths due to a large accumulation of distortion are the path passing through nodes 713 and 721, and the path passing through nodes 714 and 723. The two unselected paths are marked as "X" in FIG. 7.

The calculations just described may be performed for other nodes at stage 1 illustrated in FIG. 7.

Referring to FIG. 8, four survivor paths exist for a node 841 at a stage 2 (i.e., i=2), i.e. a path passing through nodes 811, 821, 831, and 841, a path passing through nodes 811, 822, 833, and 841, a path passing through nodes 812, 823, 831, and 841, and a path passing through nodes 812, 824, 833, and 841.

A method of multi-path trellis coded quantization according to an exemplary embodiment of the present general inventive concept calculates prediction errors $e^{1,1}_2$, $e^{3,1}_2$, $e^{2,3}_2$, and $e^{4,3}_2$ for a node 841 at stage 2 by using sub-codebook values calculated in a previous operation. Also, the method of multi-path trellis coded quantization respectively compares entries of a sub-codebook $D^2_{1,1}$ with the prediction errors $e^{1,1}_2$ and $e^{3,1}_2$. Also, the method of multi-path trellis coded quantization respectively compares entries of a sub-codebook $D^2_{3,1}$ with the prediction errors $e^{2,3}_2$ and $e^{4,3}_2$.

Next, the method of multi-path trellis coded quantization calculates distortion values $d^2_{1,1,1}$, $d^2_{3,1,1}$, $d^2_{2,3,1}$, and $d^2_{4,3,1}$ by using the prediction error values found in the sub-codebook. Also, the method of multi-path trellis coded quantization selects two paths having a smaller accumulated distortion after respectively calculating an accumulated distortion of $d^2_{1,1,1}+d^1_{1,1,1}$, $d^2_{3,1,1}+d^1_{2,3,1}$, $d^2_{2,3,1}+d^1_{1,2,3}$, and $d^2_{4,3,1}+d^1_{2,4,3}$.

The calculations just described may be performed for other nodes at stage 2 illustrated in FIG. 8.

The operations described in FIGS. 6, 7, and 8 are repeatedly performed at each stage. Two survivor paths respectively occur for four nodes (i.e., nodes 1-4) at a final stage (i.e., stage 3) of a trellis, so that the method of multi-path trellis coded quantization of the present general inventive concept may select an optimal path having a smallest accumulated distortion among eight paths.

Figure 9:
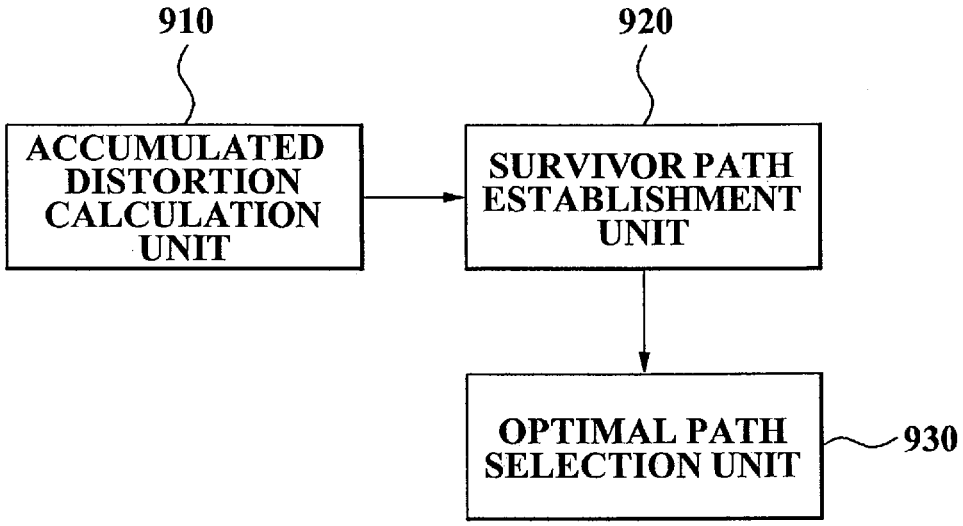
FIG. 9 is a block diagram illustrating a quantizer usable in multi-path trellis coded quantization according to an embodiment of the present general inventive concept.

FIG. 9 is a block diagram illustrating a quantizer for multi-path trellis coded quantization according to an embodiment of the present general inventive concept.

Referring to FIG. 9, a quantizer of multi-path trellis coded quantization according to an exemplary embodiment of the present general inventive concept includes an accumulated distortion calculation unit 910, a survivor path establishment unit 920, and an optimal path selection unit 930.

The accumulated distortion calculation unit 910 receives an input signal which has frames and calculates accumulated distortion values corresponding to each of 2N survivor paths, wherein the N indicates an integer greater than two, each of the 2N survivor paths going toward one of nodes at an $i^{th}$ stage of a trellis, and the i indicates an integer greater than zero.

The survivor path establishment unit 920 compares accumulated distortion values respectively corresponding to the 2N survivor paths to select N paths from among the 2N survivor paths, wherein the accumulated distortion values corresponding to the selected N paths are smaller than the accumulated distortion values corresponding to unselected N paths, and establishes the selected N paths as survivor paths going toward an $i+1^{th}$ stage.

The accumulated distortion calculation unit 910 and the survivor path establishment unit 920 repeatedly perform the calculations corresponding to FIGS. 6, 7, and 8 at each stage i by increasing i by one.

The optimal path selection unit 930 selects an optimal path from among the 2N survivor paths corresponding to each node of a last stage of the trellis structure of the input signal.

Figure 10:
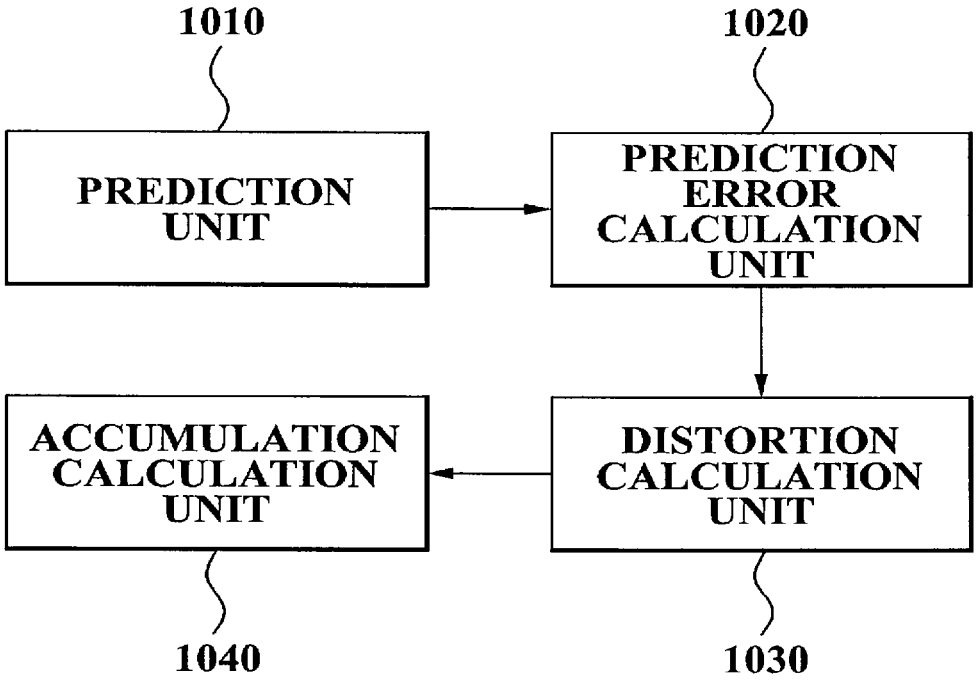
FIG. 10 is a block diagram of an embodiment of an accumulated distortion calculation unit of FIG. 9.

FIG. 10 is a block diagram illustrating an embodiment of an accumulated distortion calculation unit 910 of FIG. 9.

Referring to FIG. 10, the accumulated distortion calculation unit 910 illustrated in FIG. 9 includes a prediction unit 1010, a prediction error calculation unit 1020, a distortion calculation unit 1030, and an accumulation calculation unit 1040.

The prediction unit 1010 generates a predicted value corresponding to the $i^{th}$ stage of a trellis structure by using a quantized value among the 2N survivor paths.

The prediction error calculation unit 1020 calculates 2N prediction error values at the $i^{th}$ stage of the trellis structure by using the predicted value corresponding to each $i^{th}$ stage.

The distortion calculation unit 1030 calculates a distortion value between representative values selected from a sub-codebook, which are allocated to a branch corresponding to the $i^{th}$ stage of the trellis, and the predicted values. In this case, the selected representative values may have smaller distortion values included in the prediction error in the sub-codebook.

According to the exemplary embodiment of FIG. 10, the distortion calculation unit 1030 may calculate the distortion values by applying a predetermined weight to a difference between the prediction error values and the selected representative values.

The accumulation calculation unit 1040 calculates an accumulated distortion of the $i^{th}$ stage by using the calculated distortion values.

In this case, operations of the accumulation calculation unit 1040 illustrated in FIG. 10 will not be described here since the operation has been described with respect to FIGS. 6, 7, and 8.

The methods of multi-path trellis coded quantization of the present general inventive concept, and a quantizer using the methods may be used to quantize a prediction error performed among frames of an input signal. Also, the methods of multi-path trellis coded quantization of the present general inventive concept, and a quantizer using the methods may be used to quantize a preprocessed input signal. Also, the multi-path trellis coded quantization methods and quantizer may be used to quantize prediction values between input signal frames or within a single input signal frame. The prediction values may be line spectrum frequency coefficient values, and the input signal may be a voice or speech signal and the line spectrum frequency coefficient values may be closely associated with a frequency property of the voice or speech signal.

The methods of multi-path trellis coded quantization of the present general inventive concept and the quantizer using the methods improve performance of quantization at a lower transmission rate.

The methods of multi-path trellis coded quantization of the present general inventive concept and the quantizer using the method solve a problem occurring when only one survivor path is stored in a trellis coded quantization using a correlation of frames in an input signal.

The methods of multi-path trellis coded quantization of the present general inventive concept and the quantizer using the methods improve performance of quantization by effectively performing quantization of an input signal and a coefficient in a speech coding system using a BC-TCQ.

The present general inventive concept can also be embodied as computer-readable codes on a computer-readable recording medium. The computer-readable recording medium is any data storage device that can store data which can be thereafter read by a computer system. Examples of the computer readable recording medium include magnetic storage media (e.g., ROM, floppy disks, hard disks, etc.), optical recording media (e.g., CD-ROMs, or DVDs), and other such storage media. The computer-readable recording medium can also be distributed over network-coupled computer systems so that the computer-readable code is stored and executed in a distributed fashion. Also, functional programs, codes, and code segments to accomplish the present general inventive concept can be easily construed by programmers skilled in the art to which the present general inventive concept pertains. The methods illustrated in FIGS. 6, 7, and 8 can be stored in the computer-recorded medium in a form of computer-readable codes to perform the method when the computer reads the computer-readable codes of the recording medium.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of multi-path trellis coded quantization, the method comprising:

calculating, using a processor, accumulated distortions corresponding to 2N survivor paths, wherein N indicates an integer not less than two, such that 2N indicates an integer not less than four, each of the 2N survivor paths going towards one of nodes at an $i^{th}$ stage of a trellis, and i indicates an integer not less than zero, the calculating accumulated distortions including:

calculating a distortion between representative values selected from a sub-codebook which is allocated to a branch corresponding to the $i^{th}$ stage of the trellis and calculated predicted errors at the $i^{th}$ stage of the trellis; and calculating the accumulated distortion of the $i^{th}$ stage by using calculated distortion; and comparing the accumulated distortions respectively corresponding to the 2N survivor paths to select N paths among the 2N survivor paths, wherein the accumulated distortions corresponding to selected N paths are smaller than the accumulated distortions corresponding to unselected N paths;

establishing the selected N paths as survivor paths going toward an $i+1^{th}$ stage; and selecting an optimal path among the 2N survivor paths corresponding to each node of an $i+2^{th}$ stage, wherein the calculating of the distortion between representative values and the predicted errors calculates the distortion by applying a predetermined weight to a difference between the prediction errors and the selected representative values, and wherein the optimal path is dismissed when only one survivor path is saved for one node at each stage.

2. The method of claim 1, wherein the calculating accumulated distortions further comprises:

generating a predicted value corresponding to the $i^{th}$ stage of the trellis by using a quantized value among the 2N survivor paths; and the calculating the predicted errors includes calculating 2N prediction errors at the $i^{th}$ stage of the trellis by using the predicted value.

3. The method of claim 2, wherein the selected representative values have a small distortion and are included in the prediction errors in the sub-codebook.

4. The method of claim 1, wherein the method of multi-path trellis coded quantization is used to quantize a prediction error performed among frames of an input signal.

5. The method of claim 1, wherein the method of multi-path trellis coded quantization is used to quantize a preprocessed input signal.

6. A multi-path trellis coded quantizer, the quantizer comprising:

an accumulated distortion calculation unit to calculate accumulated distortion corresponding to 2N survivor paths, wherein N indicates an integer not less than two, such that 2N indicates an integer not less than four, each of the 2N survivor paths is going toward one of nodes at an $i^{th}$ stage of a trellis, and i indicates an integer not less than zero, the accumulated distortion calculation unit including:

a distortion calculation unit to calculate a distortion between representative values selected from a sub-codebook which is allocated to a branch corresponding to the $i^{th}$ stage of the trellis and calculated predicted errors at the $i^{th}$ stage of the trellis; and an accumulation calculation unit to calculate the accumulated distortion of the $i^{th}$ stage by using the calculated distortion; and a survivor path establishment unit to compare the accumulated distortions respectively corresponding to the 2N survivor paths to select N paths among the 2N survivor paths, wherein the accumulated distortions corresponding to selected N paths are smaller than the accumulated distortions corresponding to unselected N paths, and to establish the selected N paths as survivor paths going toward an $i+1^{th}$ stage; and an optimal path selection unit to select an optimal path among the 2N survivor paths corresponding to each node of a last stage, wherein the distortion calculation unit calculates the distortion between representative values and the predicted errors by applying a predetermined weight to a difference between the prediction errors and the selected representative values, and wherein the optimal path is dismissed when only one survivor path is saved for one node at each stage.

7. The quantizer of claim 6, wherein the accumulated distortion calculation unit comprises:

a prediction unit to generate a predicted value corresponding to the $i^{th}$ stage of the trellis by using a quantized value among the 2N survivor paths; and a prediction error calculation unit to calculate the prediction errors by calculating 2N prediction errors at the $i^{th}$ stage of the trellis by using the predicted value.

8. The quantizer of claim 7, wherein the selected representative values have a small distortion and are included in the prediction errors in the sub-codebook.

9. The quantizer of claim 6, wherein the quantizer is used to quantize a prediction error performed among frames of an input signal.

10. The quantizer of claim 6, wherein the quantizer is used to quantize a preprocessed input signal.

11. A non-transitory computer-readable recording medium having embodied thereon a computer program to execute a method of multi-path trellis coded quantization, the method including:

calculating accumulated distortions corresponding to 2N survivor paths, wherein N indicates an integer not less than two, such that 2N indicates an integer not less than four, each of the 2N survivor paths going towards one of nodes at an $i^{th}$ stage of a trellis, and i indicates an integer not less than zero, the calculating accumulated distortions including:

calculating a distortion between representative values selected from a sub-codebook which is allocated to a branch corresponding to the $i^{th}$ stage of the trellis and calculated predicted errors at the $i^{th}$ stage of the trellis; and calculating the accumulated distortion of the $i^{th}$ stage by using calculated distortion; and comparing the accumulated distortions respectively corresponding to the 2N survivor paths to select N paths among the 2N survivor paths, wherein the accumulated distortions corresponding to selected N paths are smaller than the accumulated distortions corresponding to unselected N paths;

establishing the selected N paths as survivor paths going toward an $i+1^{th}$ stage; and selecting an optimal path among the 2N survivor paths corresponding to each node of a last stage, wherein the calculating of the distortion between representative values and the predicted errors calculates the distortion by applying a predetermined weight to a difference between the prediction errors and the selected representative values, and wherein the optimal path is dismissed when only one survivor path is saved for one node at each stage.

12. A method of trellis coded quantization, the method comprising:

determining a plurality of survivor paths from a node of a first stage to a node of a last stage of a trellis structure;

calculating, using a processor, accumulated distortion values for each of the plurality of survival paths, the distortion values being determined based on a difference between predicted values and representative values of a sub-codebook; and selecting an optimal path from the plurality of survivor paths as a survival path based on the accumulated predetermined variable value, wherein the plurality of survivor paths is at least 2N, where N is at least 2, and a number of survivor paths between any two stages is not less than N, and wherein the calculating of the accumulated distortion between representative values and the predicted values is by applying a predetermined weight to a difference between the predicted values and selected representative values, and wherein the optimal path is dismissed when only one survivor path is saved for one node at each stage.

13. A method of coding a voice input signal, the method comprising:

calculating, using a processor, linear predictive coding (LPC) coefficients corresponding to the voice input signal;

calculating line spectrum frequency (LSF) coefficients based on the LPC coefficients;

trellis code quantizing the LSF coefficients, the trellis code quantizing comprising:

determining a plurality of survivor paths from a node of a first stage to a node of a last stage of a trellis structure, the plurality of survivor paths having a quantity of 2N, wherein N indicates an integer not less than two, such that 2N indicates an integer not less than four, calculating accumulated distortion values for each of the plurality of survival paths, the distortion values being determined based on a difference between predicted values and representative values of a sub-codebook, and selecting an optimal path from the plurality of survivor paths as a survival path based on the accumulated predetermined variable value; and generating a bitstream according to the quantized LSF coefficients, wherein the calculating of the accumulated distortion between representative values and the predicted values is by applying a predetermined weight to a difference between the predicted values and selected representative values, and wherein the optimal path is dismissed when only one survivor path is saved for one node at each stage.

14. The voice input signal coding method of claim 13, wherein the LSF coefficients are calculated based on a correlation of coefficient values between frames of the voice input signal.

15. The voice input signal coding method of claim 13, wherein the LSF coefficients are calculated based on a correlation of adjacent coefficient values within a single frame of the voice input signal.

16. The voice input signal coding method of claim 13, wherein the trellis code quantizing of the LSF coefficients is performed using vector quantization.

17. A method of searching a trellis structure, the method comprising:

determining 2N survivor paths between a first node of an $i^{th}$ stage and a second node of an $i+1^{th}$ stage of a trellis structure;

calculating, using a processor, a predetermined variable corresponding to each of the 2N survivor paths, the calculated predetermined variable being determined based on a difference between predicted values and representative values of a sub-codebook and by applying a predetermined weight to a difference between the predicted values and selected representative values; and selecting N survivor paths from among the 2N survivor paths based on the predetermined variable, wherein N is an integer not less than 2, such that 2N is an integer not less than 4, and dismissing N as a survivor path when N is an integer less than 2 that is saved for one node at each stage.

18. The trellis structure searching method of claim 17, wherein the predetermined variable is a distortion value.

* * * * *